US007011364B2

(12) United States Patent
Meskill et al.

(10) Patent No.: US 7,011,364 B2
(45) Date of Patent: Mar. 14, 2006

(54) TABLE WITH FOLDING LEGS

(75) Inventors: James F. Meskill, Pepper Pike, OH (US); Jeffrey Kalman, Cleveland Heights, OH (US); Gary Robert Stephan, Seven Hills, OH (US); Craig Saunders, Rocky River, OH (US); David Boll, Avon, OH (US)

(73) Assignee: J.F. Meskill Enterprises, L.L.C., Cleveland, OH (US)

( * ) Notice: Subject to any disclaimer, the term of this patent is extended or adjusted under 35 U.S.C. 154(b) by 0 days.

(21) Appl. No.: 10/886,455

(22) Filed: Jul. 7, 2004

(65) Prior Publication Data

US 2005/0006931 A1 Jan. 13, 2005

Related U.S. Application Data

(60) Provisional application No. 60/485,810, filed on Jul. 9, 2003.

(51) Int. Cl.

| | |
|---|---|
| ***A47B 83/02*** | (2006.01) |
| ***A47B 3/14*** | (2006.01) |
| ***A47B 3/00*** | (2006.01) |
| ***A47B 85/00*** | (2006.01) |
| ***F16M 11/32*** | (2006.01) |

(52) U.S. Cl. ..... 297/158.4; 297/157.1; 297/158.3; 297/159.1; 108/25; 108/127; 108/128; 108/131; 108/132; 248/439

(58) Field of Classification Search ..... 297/158.3, 297/158.4, 159.1, 157.1; 108/132, 131, 128, 108/127; 248/439

See application file for complete search history.

(56) References Cited

U.S. PATENT DOCUMENTS

| | | | | |
|---|---|---|---|---|
| 1,757,260 | A | | 5/1930 | Silverman |
| 1,888,117 | A | | 11/1932 | Fox |
| 2,837,141 | A | | 6/1958 | Shore |
| 3,364,882 | A | * | 1/1968 | Merrick ..... 108/25 |
| 3,596,985 | A | | 8/1971 | Degagne |
| 4,165,127 | A | | 8/1979 | Vago |
| D256,533 | S | * | 8/1980 | Alessio ..... 108/127 X |
| 4,560,200 | A | | 12/1985 | Giannelli et al. |
| 4,864,941 | A | * | 9/1989 | Goulter ..... 108/132 |
| D327,177 | S | | 6/1992 | Wehmeyer |
| 5,352,015 | A | | 10/1994 | Morgan |
| 5,542,639 | A | * | 8/1996 | Wixey et al. ..... 248/439 |
| 5,592,884 | A | * | 1/1997 | Glick et al. ..... 108/25 |
| 5,683,135 | A | * | 11/1997 | Williams ..... 297/158.4 X |
| 5,692,445 | A | | 12/1997 | Winer |
| 5,785,379 | A | | 7/1998 | Pelletier |

(Continued)

FOREIGN PATENT DOCUMENTS

FR 2 553 644 A1 4/1985

(Continued)

OTHER PUBLICATIONS

PCT International Search Report, PCT/US2004/021652, Dated Mar. 8, 2005.

*Primary Examiner*—Rodney B. White
(74) *Attorney, Agent, or Firm*—Fay, Sharpe, Fagan, Minnich & McKee, LLP

(57) ABSTRACT

A table with folding legs is disclosed. The table is capable of being folded into a storage position. One embodiment of the table includes one or more seats attached to at least one of the folding legs. In one embodiment, the seats are adjustable horizontally and vertically. An embodiment of the table includes a table top provided with a cavity, the cavity capable of receiving a cooler therein.

18 Claims, 13 Drawing Sheets

U.S. PATENT DOCUMENTS

| | | | |
|---|---|---|---|
| 5,921,623 | A | 7/1999 | Nye et al. |
| D417,965 | S | 12/1999 | Strong et al. |
| 6,010,186 | A | 1/2000 | Tsay |
| D427,442 | S | 7/2000 | Shieh |
| 6,109,687 | A | 8/2000 | Nye et al. |
| 6,112,674 | A | 9/2000 | Stanford |
| D442,788 | S | 5/2001 | Nye et al. |
| 6,269,578 | B1 | 8/2001 | Callegari |
| 6,347,831 | B1 | 2/2002 | Nye et al. |
| 6,431,092 | B1 | 8/2002 | Stanford |
| 6,443,521 | B1 | 9/2002 | Nye et al. |
| 6,508,184 | B1 | 1/2003 | Winter et al. |
| 6,530,331 | B1 | 3/2003 | Stanford |
| 6,550,404 | B1 | 4/2003 | Stanford |
| 6,655,301 | B1 | 12/2003 | Stanford |

FOREIGN PATENT DOCUMENTS

| | | |
|---|---|---|
| GB | 516333 | 12/1939 |

* cited by examiner

TABLE WITH FOLDING LEGS

CROSS REFERENCE TO RELATED APPLICATIONS

This application claims the benefit under 35 U.S.C. § 119(e) of U.S. Provisional Application Ser. No. 60/485,810 filed Jul. 9, 2003, titled TABLE WITH FOLDING LEGS, which application is hereby incorporated by reference in its entirety.

BACKGROUND

The present invention generally relates to tables, and, more specifically, to tables with folding legs.

Portable tables have a variety of uses for situations in which a table is needed, but a permanent table is neither needed nor desirable. Portable tables often have legs that fold in order to provide ease of movement and storage of the table. Many conventional tables that have folding legs are bulky or awkward to collapse, move, and store, in part because of the manner in which the legs fold and the table collapses. Some conventional tables with folding legs have features designed to avoid such problems, but these features are often expensive or difficult to operate.

SUMMARY OF THE INVENTION

The present invention is a table with folding legs in which a generally rectangular table top having a top surface and a bottom surface, first and second opposed sides, and first and second opposed ends includes a corner bracket attached to the bottom surface at each corner of the table top. Each corner bracket has at least a first pair of holes disposed at a first distance from the bottom surface or a second pair of holes disposed at a second distance from the bottom surface. In one embodiment, the first distance and the second distance are different.

The table includes two generally U-shaped legs, each pivotally attached to two corner brackets. A first leg is pivotally attached to a first corner bracket and a second corner bracket at the first pair of holes. A second leg is pivotally attached to a third corner bracket and a fourth corner bracket at the second pair of holes. In this arrangement, the second leg is pivotally attached at a greater distance from the bottom surface than the first leg is pivotally attached.

The table also includes two pivot brackets, each attached to the bottom surface of the table top at opposite ends between a first side of the table top and a second side of the table top. Each pivot bracket has at least a first opening, arranged closer to the first side, and a second opening, arranged closer to the second side.

The table also includes four braces, each brace pivotally connected to a respective leg and a respective pivot bracket. At the first end, a first brace is pivotally attached to the first leg and pivotally attached to the first pivot bracket at the second opening, which is closest to the second side. The first brace has at least two bars pivotally connected to each other and lockable to selectively prevent pivot of the first brace. Likewise, a second brace is pivotally attached to the second leg and pivotally attached to the first pivot bracket at the first opening, closest to the first side. The second brace also includes first and second bars pivotally connected to each other and lockable to selectively prevent pivot of the second brace. At the other end of the table, third and fourth braces are similarly disposed between the first leg and the second pivot bracket and between the second leg and the second pivot bracket.

To fold the legs and collapse the table, the table is placed with the top surface of the table top on the ground, floor, or other surface. The first leg, which is pivotally attached closer to the bottom surface of the table top than the second leg is the first to be folded. Initially, the first and second bars of the first and third braces are unlocked and pivoted relative to each other such that the pivot point between the two bars is moved closer to the bottom surface of the table top. This enables the first leg to pivot inwardly to rest substantially adjacent the bottom surface.

Then the second leg is folded inwardly toward the bottom surface of the table to rest substantially adjacent to the first leg. This is accomplished in a similar manner to the folding of the first leg by unlocking the first and second bar of the second and fourth braces allowing the pivot point between these two bars to move toward the bottom surface of the table top. This enables the second leg to pivot inwardly toward the bottom surface of the table top.

The present invention includes other embodiments, for example, an embodiment in which there is at least one seat, preferably a bench seat, attached to each of the table legs, and an embodiment in which the table top includes an integral, collapsible, cooler.

DESCRIPTION OF THE DRAWINGS

In the accompanying drawings, which are incorporated in and constitute a part of the specification, embodiments of the invention are illustrated, which, together with a general description of the invention given above, and the detailed description given below, serve to exemplify the principles of this invention, wherein.

Although these drawings and the following detailed description describe in specificity certain embodiments of the invention, the invention and claims that follow are not in any way limited thereto. Indeed, the claims and their ordinary meanings describe the full and broad scope of the invention.

DETAILED DESCRIPTION OF THE INVENTION

Figure 1:
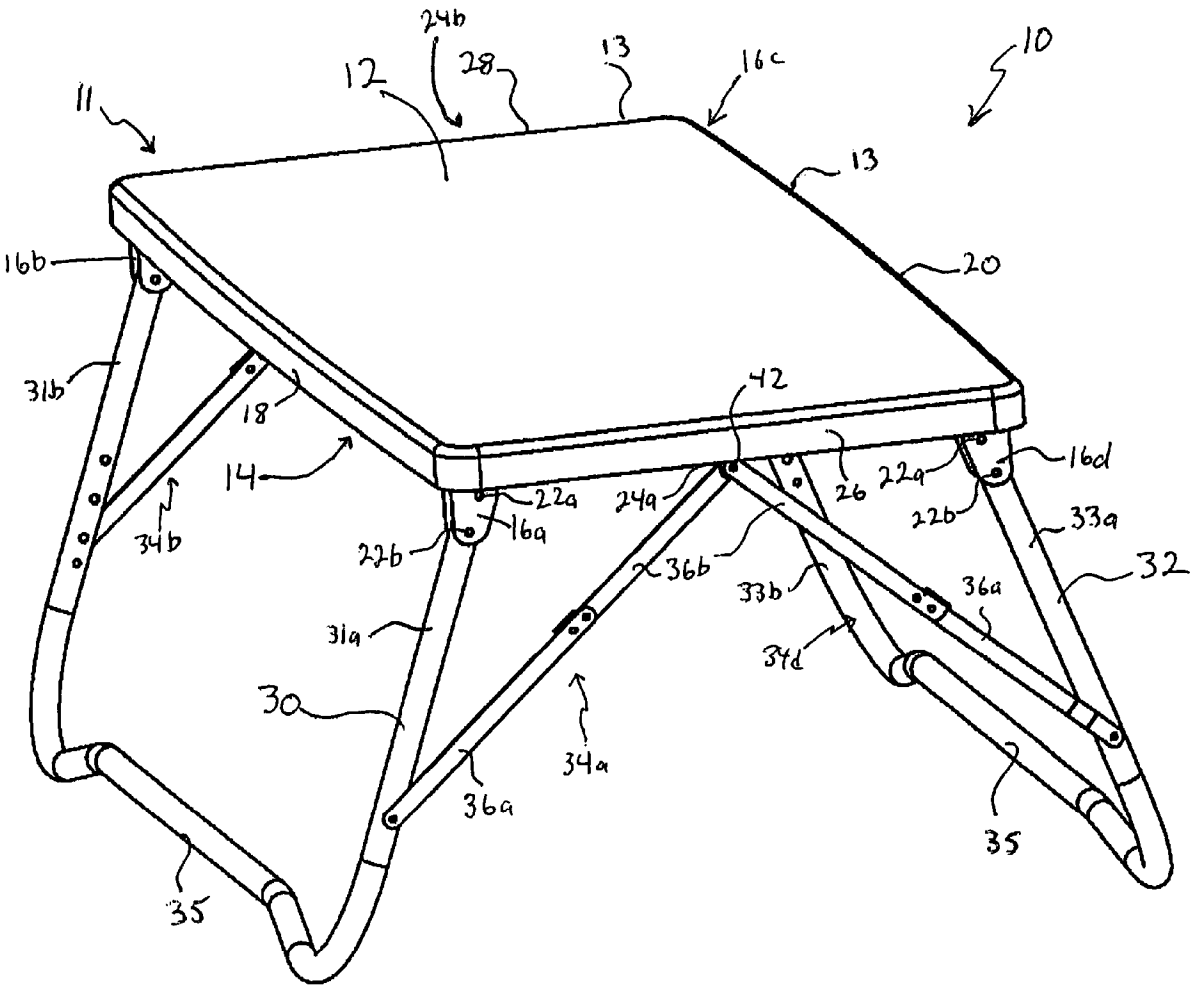
FIG. 1 is a perspective view of a table in accordance with the present invention.

FIG. 1 illustrates an embodiment of the present invention in which table 10 has a table top 11 with a top surface 12 and a bottom surface 14. Corner brackets 16*a*, 16*b*, 16*c*, and 16*d* are fixed to the bottom surface 14 at corners of the table 10. As illustrated in FIG. 1, corner brackets 16*a* and 16*b* extend at a first side 18 of the table 10 and corner brackets 16*c* and 16*d* extend at a second side 20 of table 10. In one embodiment, the top surface is rectangular with dimensions of about 32 inches by about 72 inches, but any shape and dimension may be selected without departing from the spirit and scope of the invention.

Each corner bracket 16*a, b, c, d* has at least a first pair of holes 22*a* or a second pair of holes 22*b*. Any corner bracket may also have a first pair of holes 22*a* and a second pair of holes 22*b*. All of the second holes 22*b* are disposed at a greater distance from the bottom surface 14 than the first hole 22*a* in any corner bracket 16*a, b, c, d*.

The corner brackets 16*a, b, c, d* may be affixed at the bottom surface 14 in any conventional manner. Preferably, the brackets 16*a, b, c, d* include a tongue bar (not shown) that cooperates with a channel (not shown) in the bottom surface 14 such that the tongue bar is inserted into the channel. For further support, a screw, bolt, rivet, brad, nail, or other fastener is inserted through the bottom surface 14, through the tongue bar of the corner bracket 16, and further into the table top 11.

Figure 2:
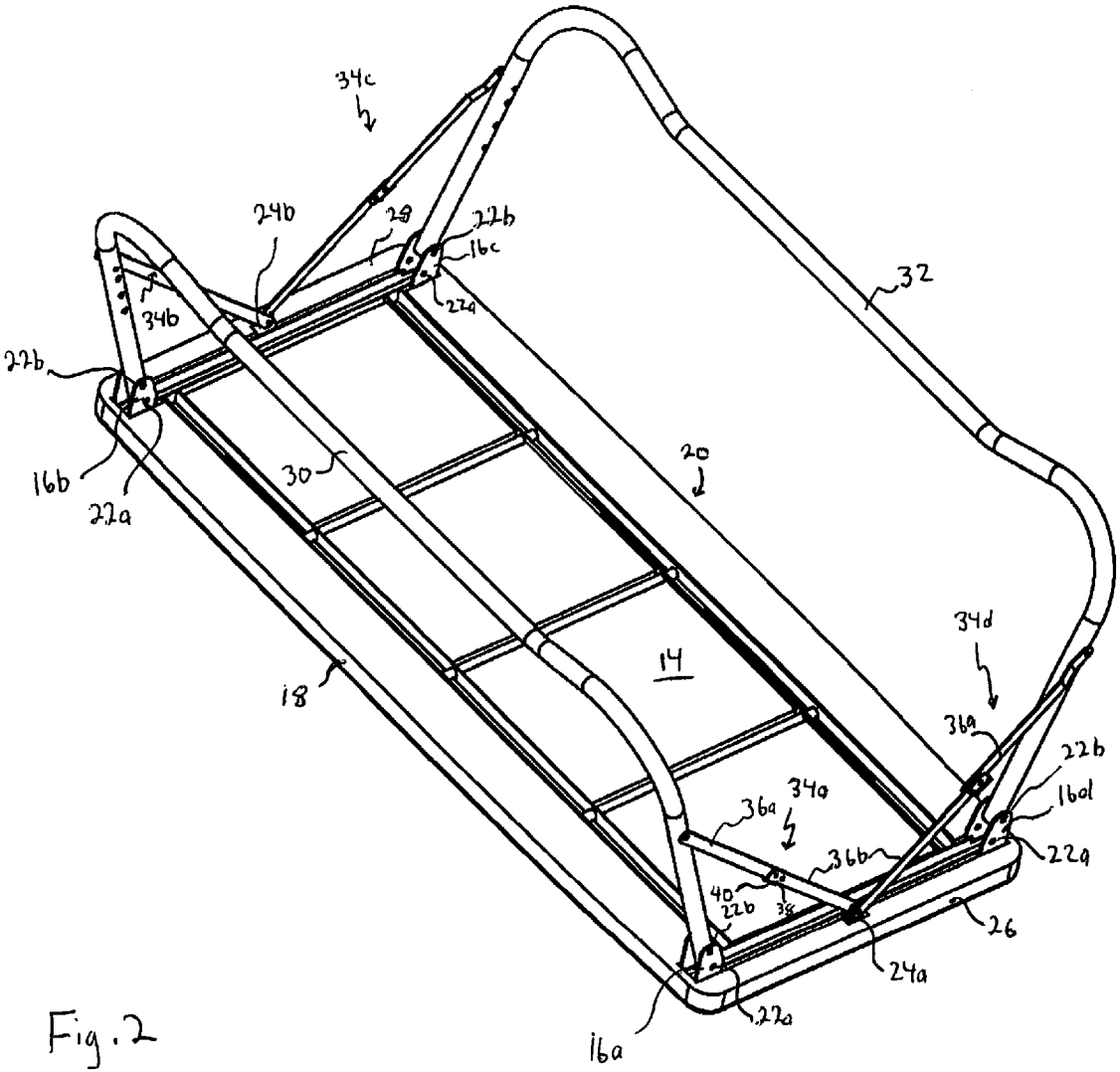
FIG. 2 is a perspective view of the underneath of a table in accordance with the present invention.
Figure 8:
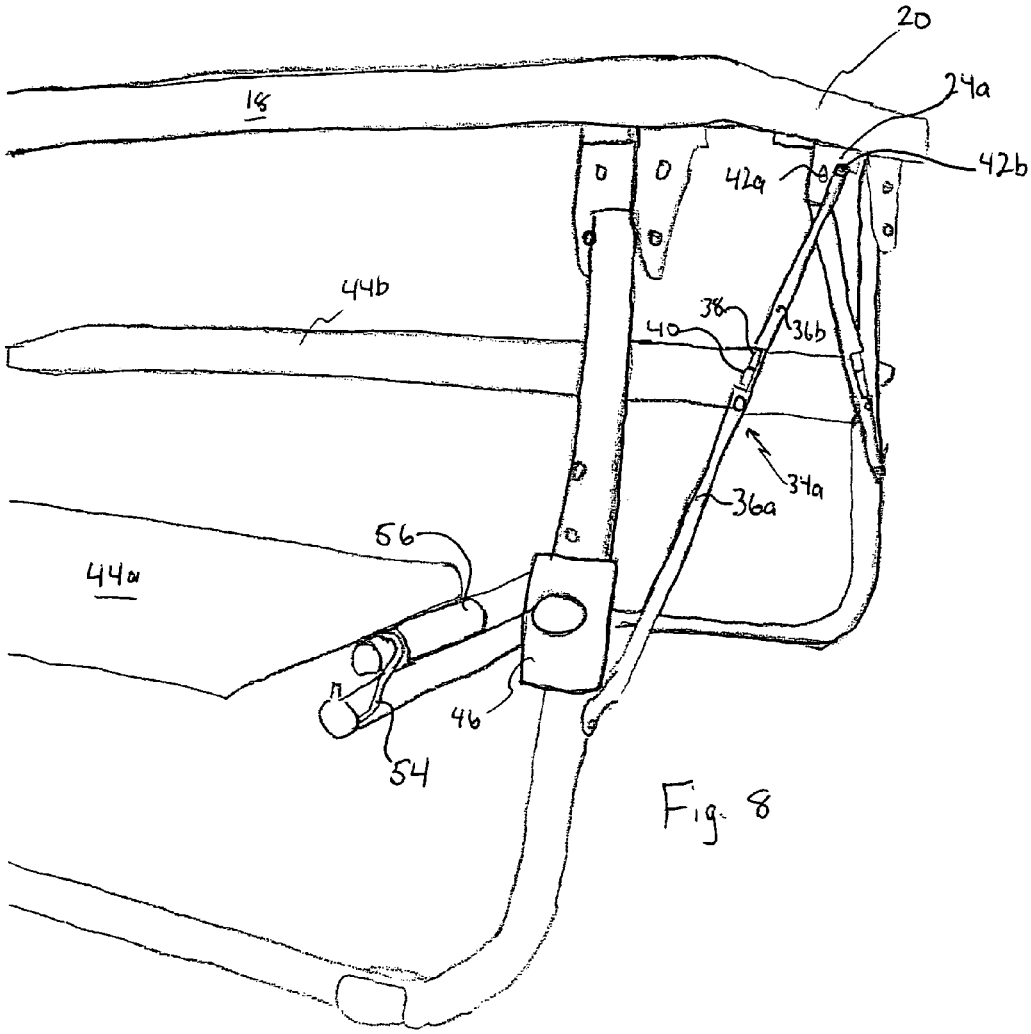
FIG. 8 is a perspective view of another embodiment of the present invention illustrating adjustable seat attachment.

Also attached at the bottom surface 14 are pivot brackets 24*a* and 24*b*. Pivot bracket 24*a* is attached to the bottom surface 14 near a first end 26 of the table and pivot bracket 24*b* is attached to the bottom surface 14 near a second end 28 of the table. The pivot brackets 24*a, b* are attached to the bottom surface 14 in any conventional manner. Preferably, the pivot brackets 24*a, b* are attached in a similar manner as are corner brackets 16*a, b, c, d*. FIG. 2 illustrates the placement of the pivot brackets 24*a, b*. Preferably, the pivot brackets 24*a, b* are located at the respective ends 26, 28 about midway between the sides 18, 20. FIG. 8 illustrates an embodiment in which the pivot brackets 24*a, b* have a first opening 42*a*, nearest side 18, and a second opening 42*b*, nearest side 20.

As further illustrated in FIG. 1, a first leg 30 is pivotally attached to corner brackets 16*a* and 16*b* via first pair of holes 22*a*. First leg 30 includes members 31*a* and 31*b* that are substantially vertical when the table 10 is placed in an upright position. Likewise, a second leg 32 is attached to corner brackets 16*c* and 16*d* via second pair of holes 22*b*. Second leg 32 includes member 33*a* and 33*b* that are substantially vertical when the table 10 is placed in an upright position. Members 31*a, b*, 33*a, b* need not be perfectly vertical, but are generally disposed at an angle between about 70 degrees and about 110 degrees with respect to the surface on which the table 10 is placed in an upright position.

Both first leg 30 and second leg 32 are generally U-shaped, and are attached to the corners of the bottom surface 14 via the corner brackets 16*a, b, c, d*. Preferably, the attachment is permanent, such as by rivets or permanent pin, but the attachment may be in any conventional manner, including nuts and bolts, without departing from the spirit and scope of the invention.

While the legs 30, 32 are preferably substantially U-shaped, it is preferred that the legs 30, 32 have an offset portion 35, as illustrated in FIG. 1. This offset portion 35 results in the bottom portion of the leg being set off from the ground or other surface upon which the table 10 will rest. Even with the offset portions 35, the legs 30, 32 are substantially U-shaped.

Diagonal support braces 34*a, b, c* and *d* are connected to the pivot brackets 24*a, b* and to the respective first leg 30 and second leg 32. Each brace 34*a, b, c, d* includes a first bar 36*a* and a second bar 36*b*. The first bars 36*a* are pivotally connected to the first leg 30 or the second leg 32 and are each pivotally connected to its respective second bar 36*b*. Each second bar 36*b* is pivotally connected to the pivot bracket 24*a* or 24*b* and to its respective first bar 36*a*. The pivotal connection between any first bar 36*a* and its respective second bar 36*b* is a lockable connection.

Figure 8A:
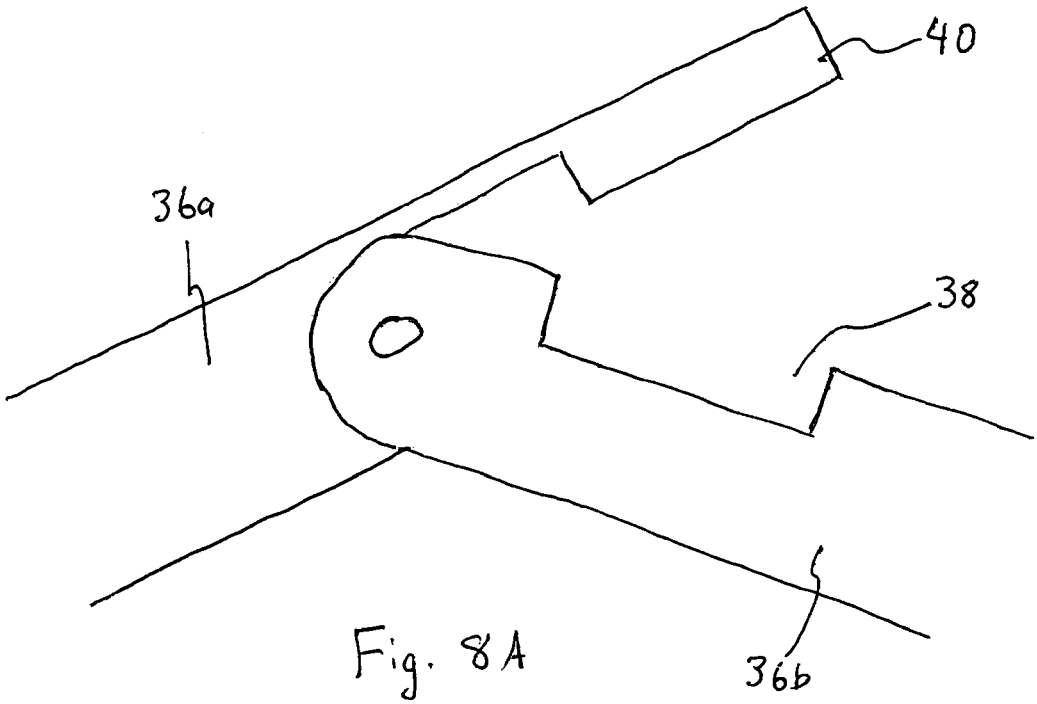
FIG. 8A is an elevational view of one embodiment of a lockable connection of the present invention.

As best seen in FIG. 8A, one embodiment of the lockable connection is a groove or notch 38 in the second bar 36*b* into which an extension 40 on first bar 36*a* fits when first bar 36*a* and second bar 36*b* are substantially aligned. This allows the braces 34*a, b, c, d* to pivot inwardly toward the bottom surface 14 and outwardly away from bottom surface 14 to the point where the first bar 36*a* and second bar 36*b* are substantially aligned. Further movement away from bottom surface 14 once the bars 36*a, b* are substantially aligned is prevented by the lockable connection. This lockable connection enables the first leg 30 and second leg 32 to be locked in place when extended away from bottom surface 14.

As shown in FIG. 8, in one embodiment, the second bar 36*b* on brace 34*a* is attached to the pivot bracket 24*a* at opening 42*b*. Likewise, second bar 36*b* on brace 34*b* is attached to the pivot bracket 24*b* at opening 42*b* (not shown in FIG. 8). The second bar 36*b* on brace 34*c* is attached to the pivot bracket 24*a* at opening 42*a* (not shown in FIG. 8). And second bar 36*b* on brace 34*d* is attached to the pivot bracket 24*b* at opening 42*a*.

Thus, each of the braces 34*a, b, c, d* is attached to the respective pivot bracket 24*a, b* through a respective opening closer to the side of the table 10 opposite to the side of the table 10 to which its respective first bar 36*a* is attached. The braces 34*a* and *d* and 34*b* and *c* cross over each other to engage respective hole 42*b* or *a* in the respective pivot bracket 24*a* or *b*. Alternatively, as illustrated in FIG. 1, the pivot bracket may have a single opening 42 at which both bars 36*b* are attached.

When folding the first leg 30 and the second leg 32 to collapse the table 10, the top surface 12 is placed on the floor, ground or other surface so the legs 30, 32 are not supporting the table 10, such as illustrated in FIG. 2. Then the extension 40 of the first bar 36*a* is disengaged from the notch 38 of the second bar 36*b* on braces 34*a* and *b*. This corresponds with the first leg 30 which is pivotally attached to corner brackets 16*a* and 16*b* via first hole 22*a*. The first bar 36*a* and second bar 36*b* are pivoted toward the bottom surface 14 enabling the first leg 30 to pivot about corner brackets 16*a* and 16*b* to nest substantially adjacent to the bottom surface 14. See FIG. 3. Then the process is repeated by disengaging extension 40 from notch 38 in braces 34*c* and 34*d*, enabling the second leg 32 to be pivoted about the corner brackets 16*c* and 16*d* about second hole 22*b*. See FIG. 2. Thus the second leg 32 may be folded essentially adjacent to the folded first leg 30. See FIG. 3.

Figure 3:
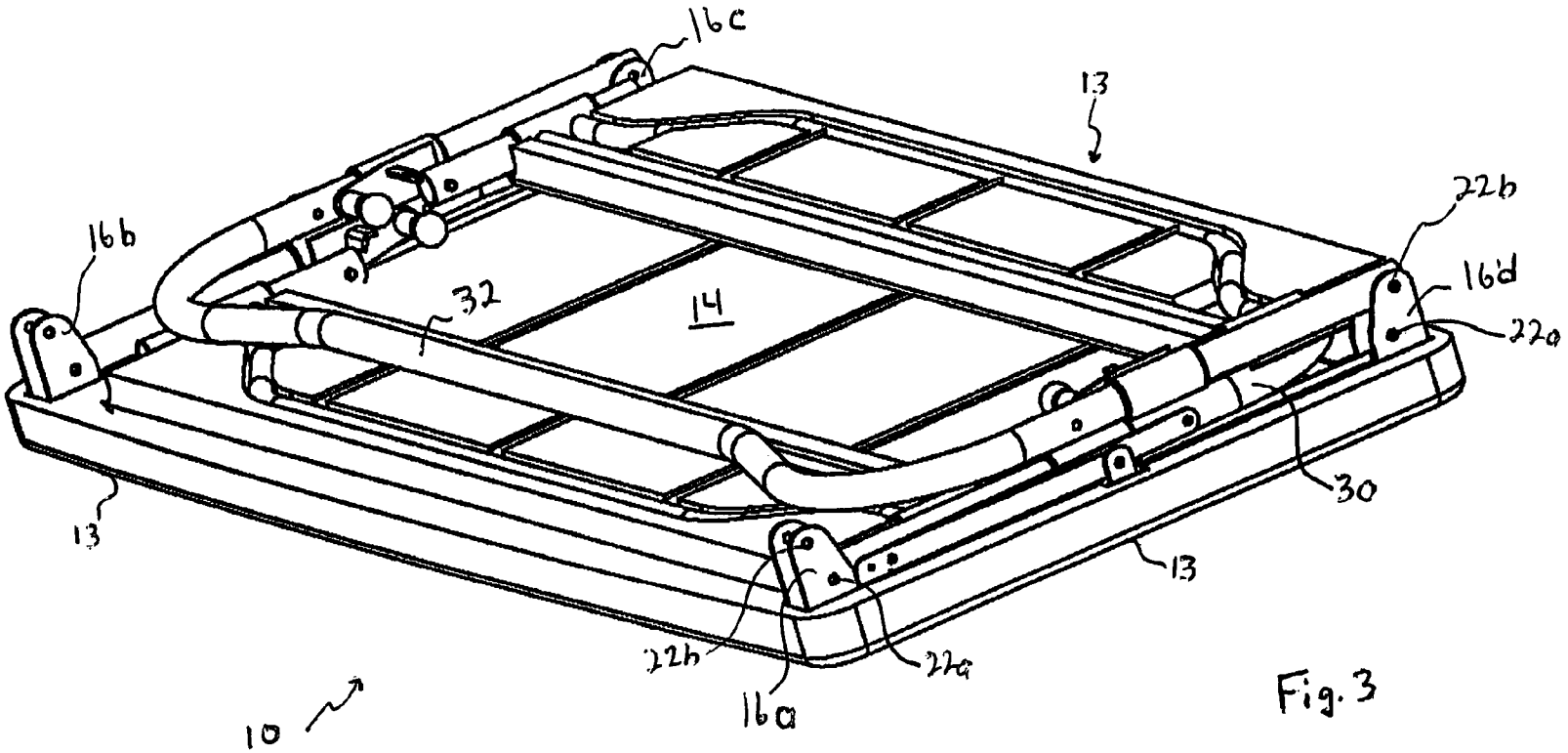
FIG. 3 is a perspective view of an embodiment of the present invention in which the legs are folded against the bottom surface of the table.

FIG. 3 also illustrates an embodiment of the table 10 including seats, as discussed in greater detail below.

Providing the pivotal connection for second leg 32 at the second pair of holes 22*b* farther away from bottom surface 14 than the pivotal connection for first leg 30 at the first pair of holes 22*a* enables second leg 32 to be folded essentially flat against the first leg 30, which is folded flat against the bottom surface 14. The folded arrangement of the legs can be seen in FIG. 3.

As can be seen from FIG. 2, if the second leg 32 were to be first folded against the bottom surface 14, then the first leg 30 would be unable to fold essentially flat against the second leg 32 and the table 10 with folded legs would not be as compact or portable. Also, by connecting the braces 34*a, b, c, d* to the respective hole 42*a, b* on the side opposite of the respective leg 30, 32 to which they are attached, as illustrated in FIG. 3, folding of the legs in a compact manner may be facilitated.

To unfold the legs from the table, the reverse procedure is used. Ensure that the top surface 12 is placed downwardly on the floor, ground, other surface, as in FIG. 2. Then second leg 32 will be pivoted about the corner brackets 16*c* and 16*d* and extended such that extension 40 engages notch 38 in braces 34*c* and 34*d*. This locks the second leg 32 into an open position. Likewise, the first leg 30 is then extended from the bottom surface 14 such that the extensions 40 engage the notches 38 in braces 34*a* and 34*b* to lock the first leg 30 in an extended position. Then the entire table may be turned over such that the first leg 30 and the second leg 32 are placed on the ground, floor, or other surface, and the top surface 12 of the table 10 is upwardly disposed.

Figure 4:
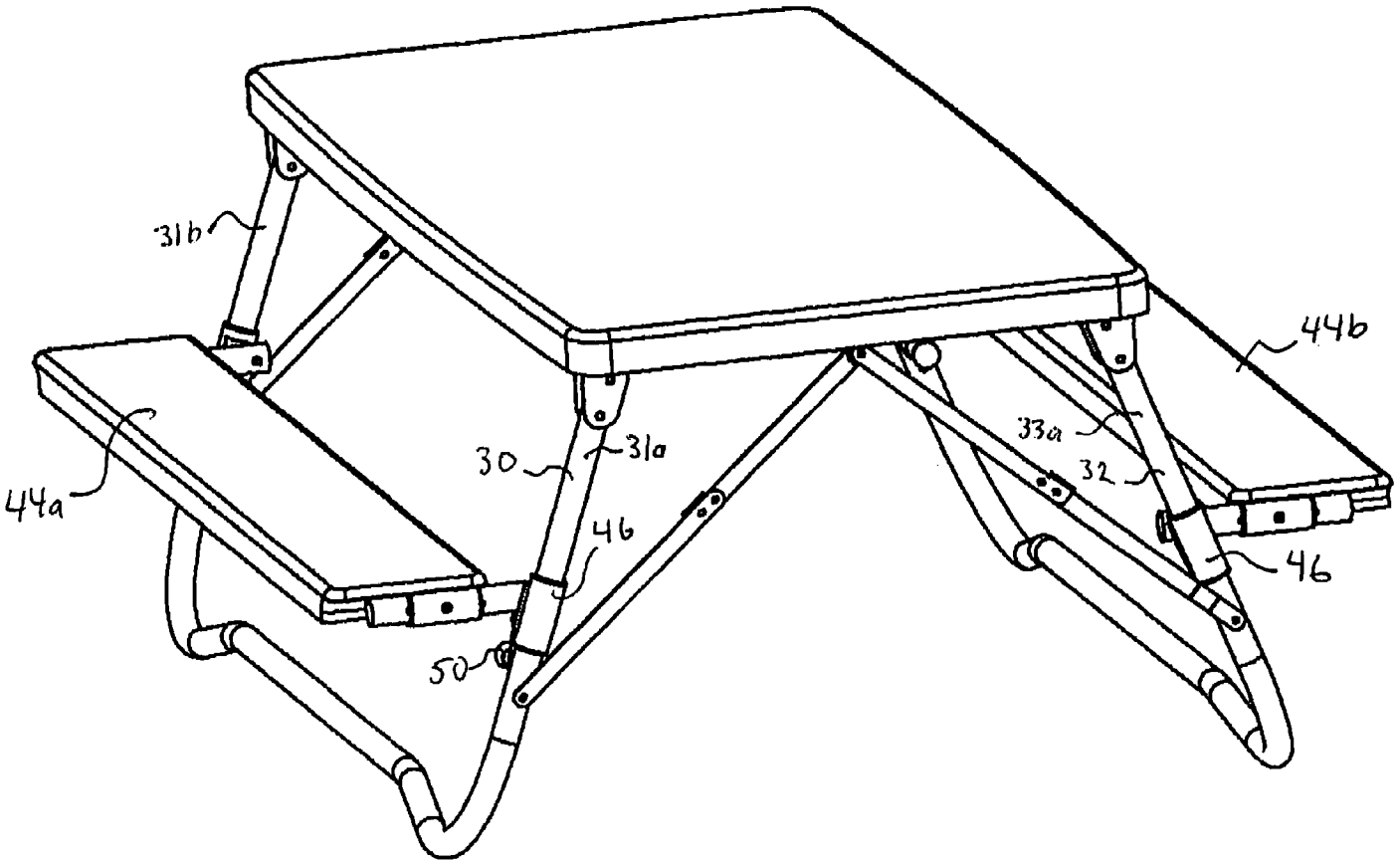
FIG. 4 is a perspective view of one embodiment of the present invention having adjustable seating.
Figure 5:
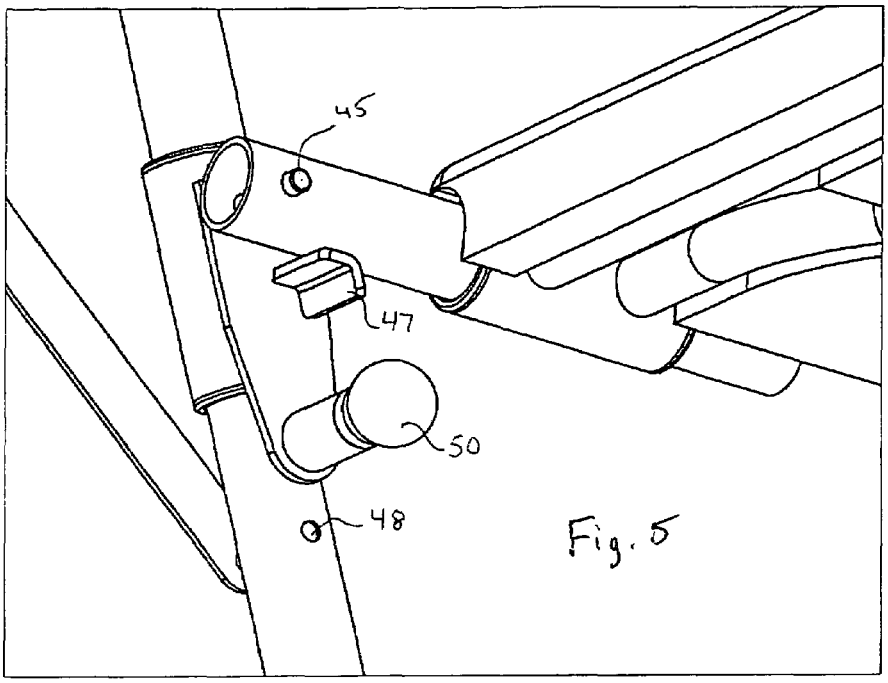
FIG. 5 is a perspective view of one embodiment of the present invention illustrating adjustable seat attachment.

In one embodiment, the table 10 is provided with seats 44*a* and 44*b*, as illustrated in FIG. 4. At least one of the seats 44*a* and 44*b* are adjustable vertically and horizontally to accommodate a user's preference. Both seats 44*a* and 44*b* may also be adjustable horizontally and vertically. In one embodiment, as illustrated in FIG. 4, the seats 44*a, b* are attached to the first leg 30 and the second leg 32, respectively, with respective leg collars 46 that slide along the members 31*a, b* of the first leg 30 and the members 33*a, b* of the second leg 32. Each of the members 31*a, b* of the first leg 30 and the members 33*a, b* of the second leg 32 is provided with a plurality of leg holes 48 into which a pin or plunger 50 is inserted to secure the respective seat 44*a, b*. This is best seen in FIG. 5. Preferably, the pin 50 is spring loaded such that it is biased towards the leg holes 48 and requires pressure exerted to pull the pin out to remove it from the leg holes 48.

Alternatively a bar may be used in place of pin 50 to be inserted through leg hole 48 to secure seat 44. Any manner of removeably and adjustably securing the leg collar 46 to the legs 30, 32 may be utilized without departing from the spirit or scope of the invention.

Seats 44*a* and 44*b* are essentially identical, except as mirror images of each other. For ease of description, seat 44*a* will be described. Seat 44*b* is essentially identical, but as a mirror image to seat 44*a*. Also, for ease of description, the structure associated with only one end of seat 44*a* will be described. This is the structure associated with the end of the seat 44*a* attached to the leg collar 46 on member 31*a*. This is essentially identical to the structure of the seat 44*a* associated with the end of the seat 44*a* attached to the leg collar 46 on member 31*b*.

Preferably, the internal surface of the leg collar 46 is provided with a lining or sleeve to facilitate sliding of the leg collar 46 up and down the member 31*a*. While any conventional material may be used in the sleeve to facilitate sliding, preferably nylon is used. Materials sold by the Dupont Corporation under the trade names Zytel® and Delrin® are believed suitable for this lining. This lining or sleeve is to reduce abrasiveness on the member 31*a* and to permit an easy glide without scratching.

As illustrated in FIGS. 4 and 5, preferably the pin 50 is pulled out or inserted in substantially the same plane in which the leg 30 lies, but perpendicular to the individual members 31*a*. Alternatively, as illustrated in FIG. 8, the pin 50 may be pulled out or inserted substantially perpendicular to the plane in which the leg 30 lies. Likewise, the leg holes 48 may be disposed in any location on the leg 30 without departing from the spirit or scope of the invention.

The seat 44*a* is pivotally connected to the leg collar 46 at pivot point 45 to enable the seat 44*a* to pivot upwardly, as illustrated in FIG. 5. However, the seat 44*a* must be prevented from pivoting down past the substantially horizontal position, as illustrated in FIG. 4. The table 10 is preferably provided with a stop 47 against which the seat rests when it is pivoted to a substantially horizontal position to prevent the seat from pivoting downwardly past a substantially horizontal position. The stop 47 is best seen in FIG. 5.

In one embodiment, illustrated in FIG. 8, the seat 44*a* includes bars 52*a, b* to provide both horizontal adjustability and the pivotable connection to the collar 46. In this embodiment, bar 52*b* is pivotally connected to the collar 46 and fastened to the bar 52*a* by means of a hook 54. Seat 44*a* is attached to a seat collar 56 that is slidably engaged with bar 52*b* for horizontal adjustability of the seat 44*a*.

Seat collar 56 is provided with a lining that may be the same or different than the lining provided in leg collar 46. Preferably, nylon is used for the lining of seat collar 56. Materials sold by the Dupont Corporation under the trade names Zytel® and Delrin® are believed suitable for this lining.

In operation, the seat collar 56 is held in place along bar 52*b* by a friction fit. As a user is seated on the seat 44*a*, that will apply a downward force on bar 52*b* by the seat collar 56, inhibiting horizontal movement of seat collar 56 and seat 44 along the bar 52*b*.

Figure 6:
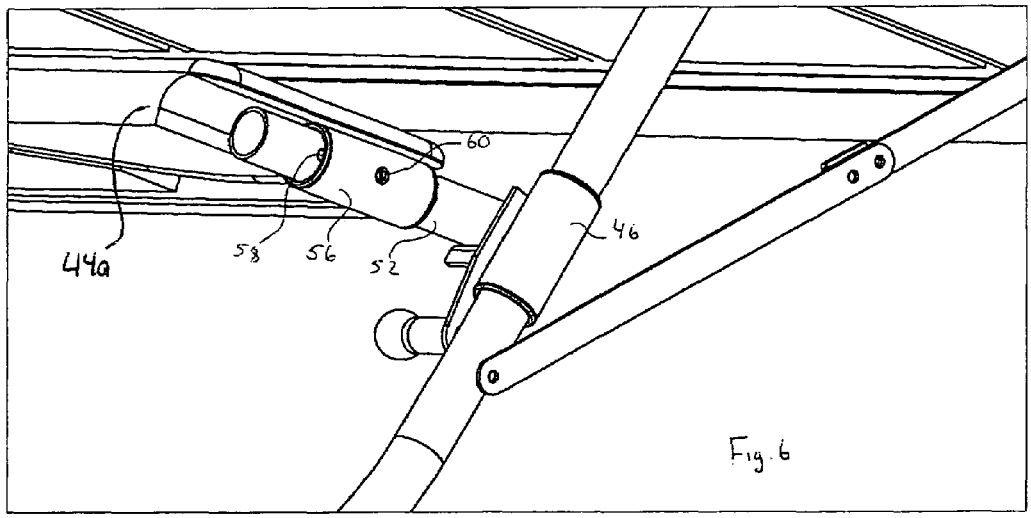
FIG. 6 is a perspective view of one embodiment of the present invention illustrating adjustable seat attachment.

FIG. 6 illustrates another embodiment of the present invention in which there is a single bar 52 pivotally attached to the leg collar 46 and fitted with a seat collar 56 attached to the seat 44*a*. In this embodiment, the bar 52 is provided with a plurality of push buttons 58 and the seat collar 56 is provided with at least one collar hole 60. The push buttons 58 are biased in an outward position to engage the collar hole 60. For horizontal adjustment of the seat 44*a*, the push button 58 is pushed into the bar 52, and the seat 44*a* is moved horizontally such that the collar hole 60 aligns with the push button 58 at the desired position of the position of the seat 44*a*. The push button 58, being biased outward, will then engage with the collar hole 60 to lock the seat 44*a* in its desired location. The number of push buttons 58 and collar holes 60 may be selected without departing from the spirit or scope of the invention.

In another embodiment, the adjustable attachment is similar to that associated with the leg collar 46 and the member 31*a* described above for the adjustable attachment of the seat to the legs. Bar 52 is provided with a plurality of holes and a spring-loaded plunger, similar to pin or plunger 50, is associated with seat collar 56 and operates in a similar manner as discussed above with relation to the pin 50 and the leg holes 48. Preferably, the spring-loaded pin or plunger is arranged downwardly from the bar 52 to not interfere with the horizontal adjustment of the seat, but may be arranged in any way without departing from the spirit and scope of the invention. A stop (not shown) may also be provided on bar 52 to prevent the seat collar 56 from displacement completely off of the bar 52.

The seats 44*a, b* are attached to the respective legs 30, 32 in a manner such that folding the legs under the table to collapse the table may also be done with the seats attached.

Figure 11:
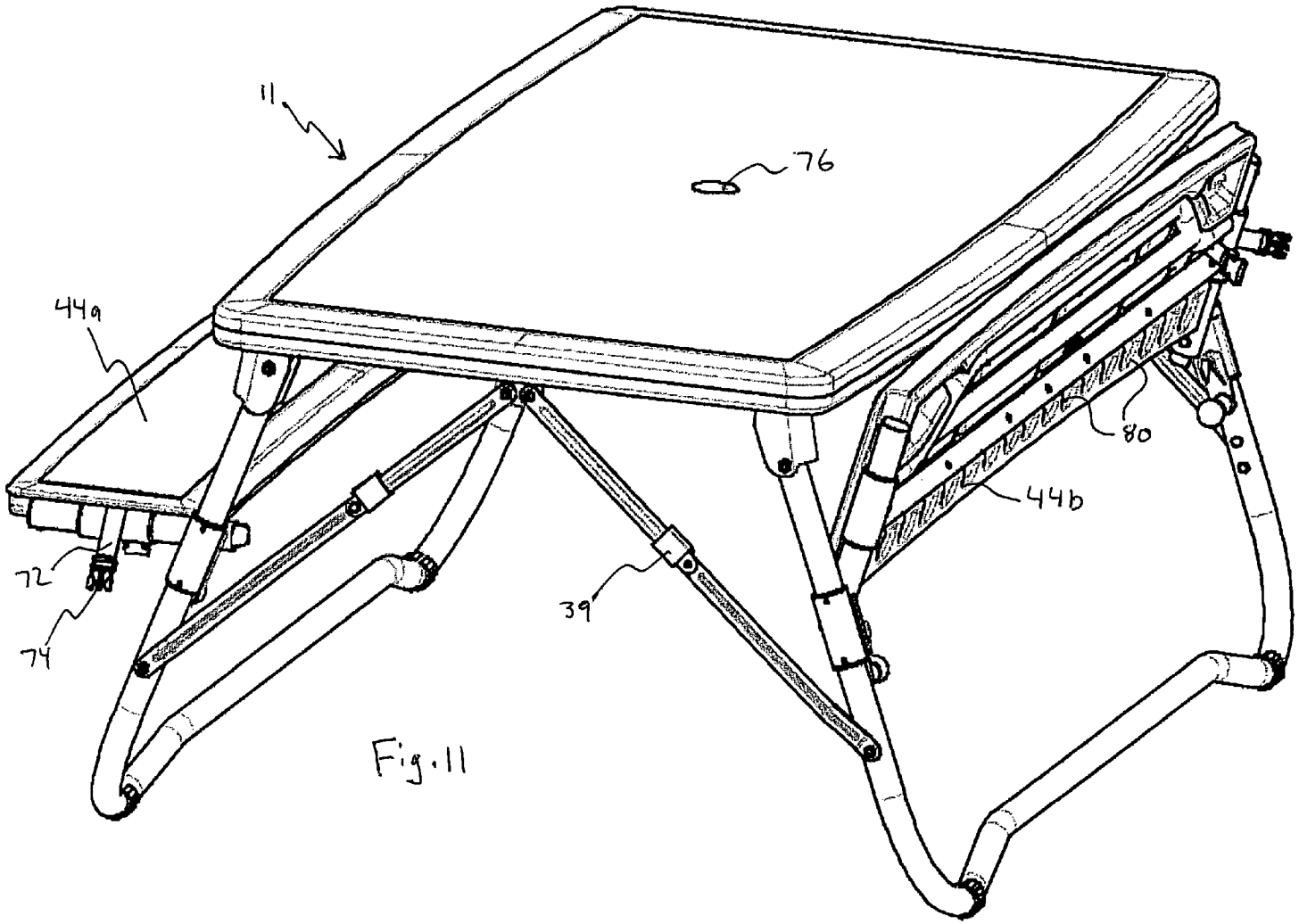
FIG. 11 is a perspective view of the embodiment in FIG. 9, with one seat pivoted upwardly.

To collapse the table in a preferred embodiment, seats 44*a, b* are first placed in the lowest height position and in the closest horizontal position to the table. Then seats 44*a, b* are pivoted upwardly about pivot point 45, such as illustrated in FIG. 11 for seat 44*b*. Then the table is turned over such that the top surface 12 rests on the ground, floor, or other surface. The legs are then folded and the table is collapsed similarly to that described above. FIG. 3 illustrates the table 10 in its collapsed position. It is preferable that the collapsed table 10 does not have any component extending beyond the perimeter or peripheral edge 13 of the top surface 12, as illustrated in FIG. 3.

Preferably, the top surface 12, bottom surface 14, and seats 44*a, b* are made from blow-molded plastic. Preferably, the first leg 30 and second leg 32 are made from tubular steel. The components of the present invention may be made from any material suitable for the particular application without departing from the spirit or scope of the invention. While certain materials may be advantageous in one application, other materials may be advantageous in different applications. Suitable materials for the top surface 12 include any rigid surface, such as wood, metal, plastic, polymer, slate, or any other rigid material suitable for providing a table top surface. The seats 44*a, b* may be selected from any material suitable to support the anticipated weight to be placed on the seats 44*a, b*. Suitable materials include plastic, steel, wood, polymers, fabric, or any other suitable material.

Figure 7:
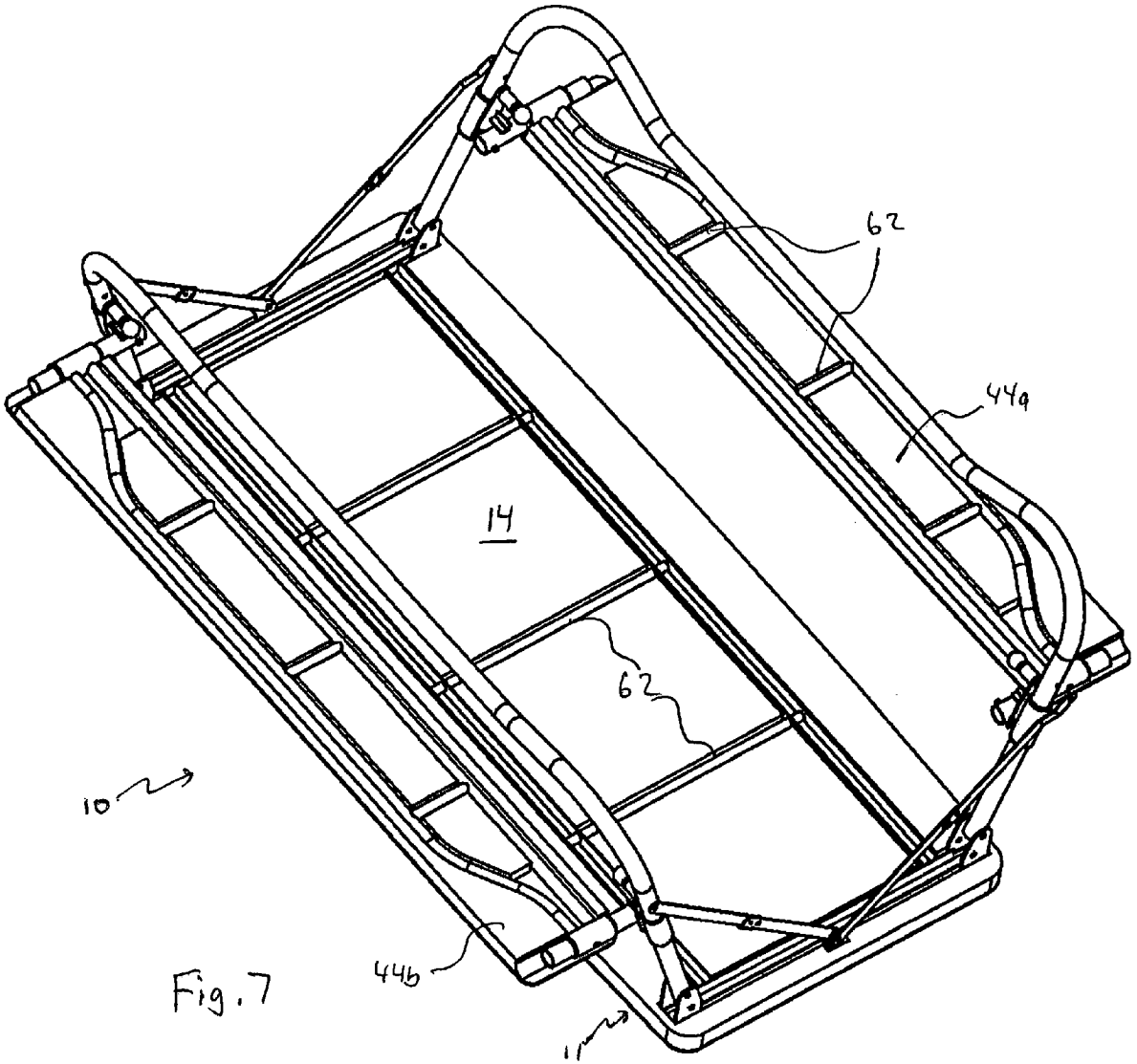
FIG. 7 is a perspective view of the underneath side of a table in accordance with the present invention.

As illustrated in FIG. 7, the seats 44*a, b* and the table top 11 may be provided with additional supports 62, depending upon the preference of the user. Such supports 62 may be embedded or placed inside the seats 44*a, b* or table top 11 or adjacent the bottom surface 14 of the table 10 or of the seats 44*a, b*, or in any other configuration to provide suitable support without departing from the spirit and scope of the invention.

Figure 9:
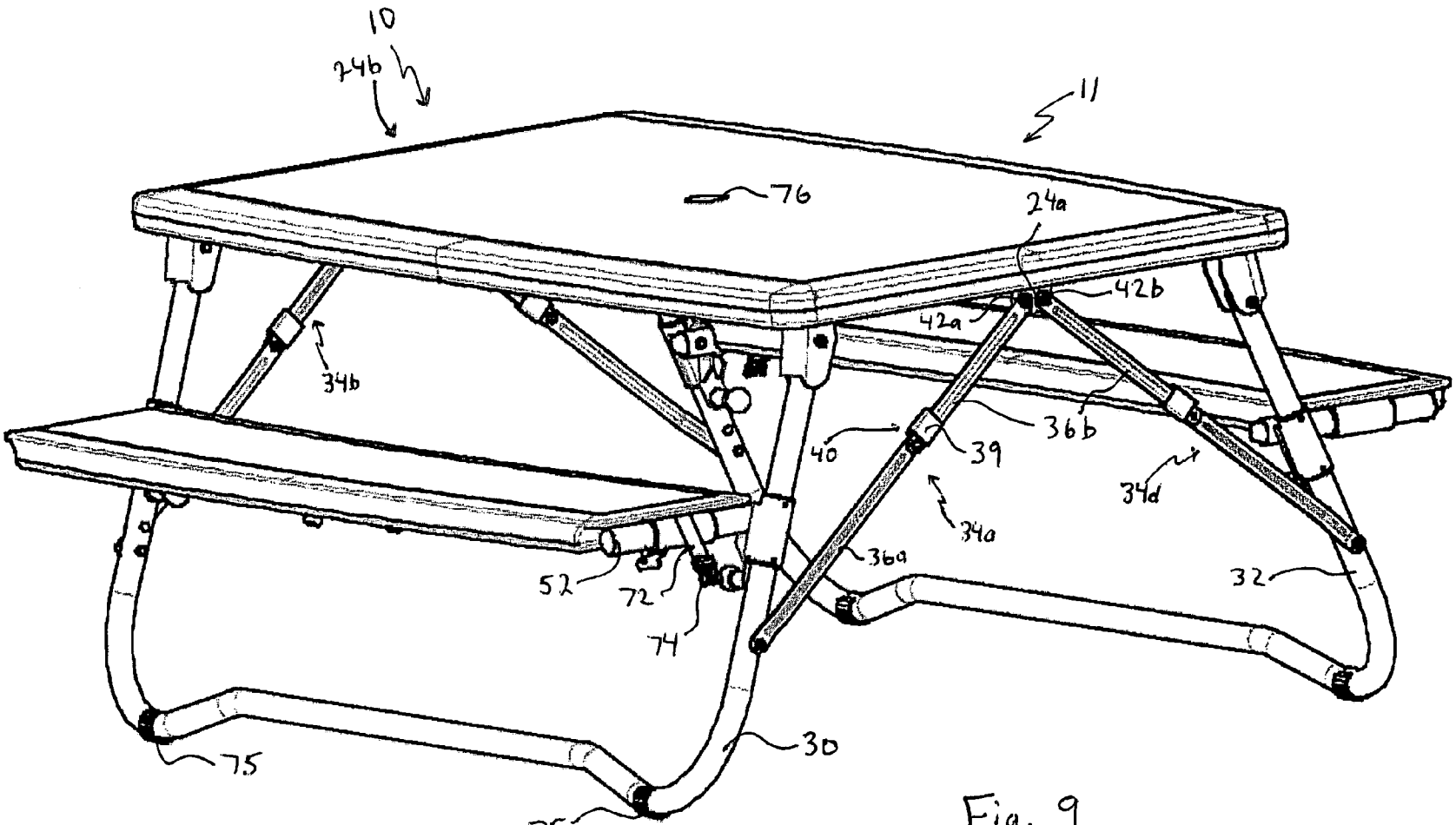
FIG. 9 is a perspective view of another embodiment of the present invention.
Figure 10:
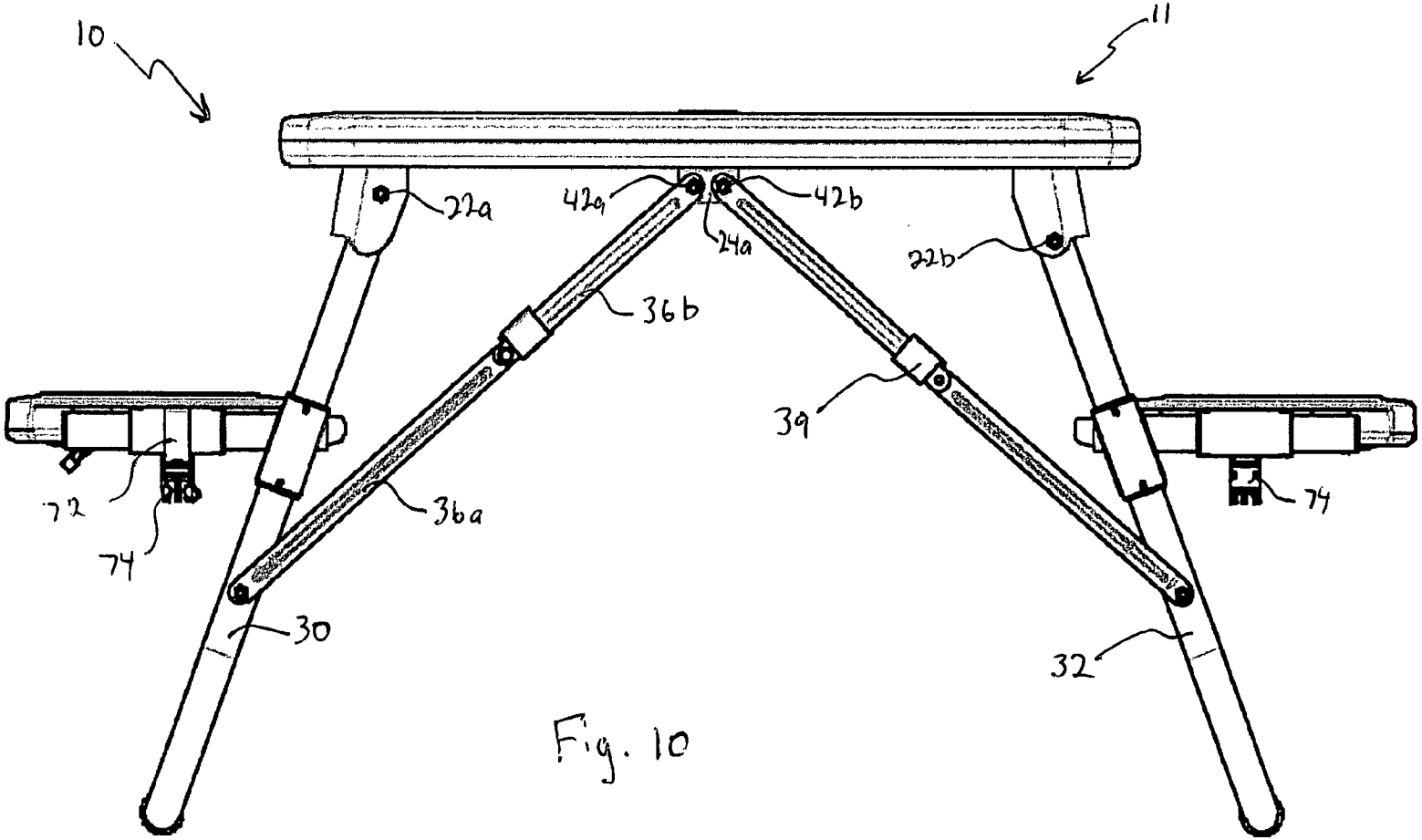
FIG. 10 is a side elevational view of the embodiment of FIG. 9.

FIGS. 9 and 10 illustrate another embodiment of the present invention. In this embodiment, the lockable connection includes a slider 39 disposed on the second bar 36*b*. The slider 39 is capable of sliding along second bar 36*b* and engaging the extension 40 on first bar 36*a*. Engagement of the extension 40 prevents the first bar 36*a* and the second bar 36*b* from substantially pivoting relative to each other. Thus, the first bar 36*a* and the second bar 36*b* are locked.

When disengaging this lockable connection, the slider 39 is moved along the second bar 36*b* toward the pivot bracket 24*a*, thus disengaging the extension 40. This enables the first bar 36*a* and the second bar 36*b* to pivot relative to each other and folded essentially adjacent to each other. See FIGS. 3 and 12.

Figure 12:
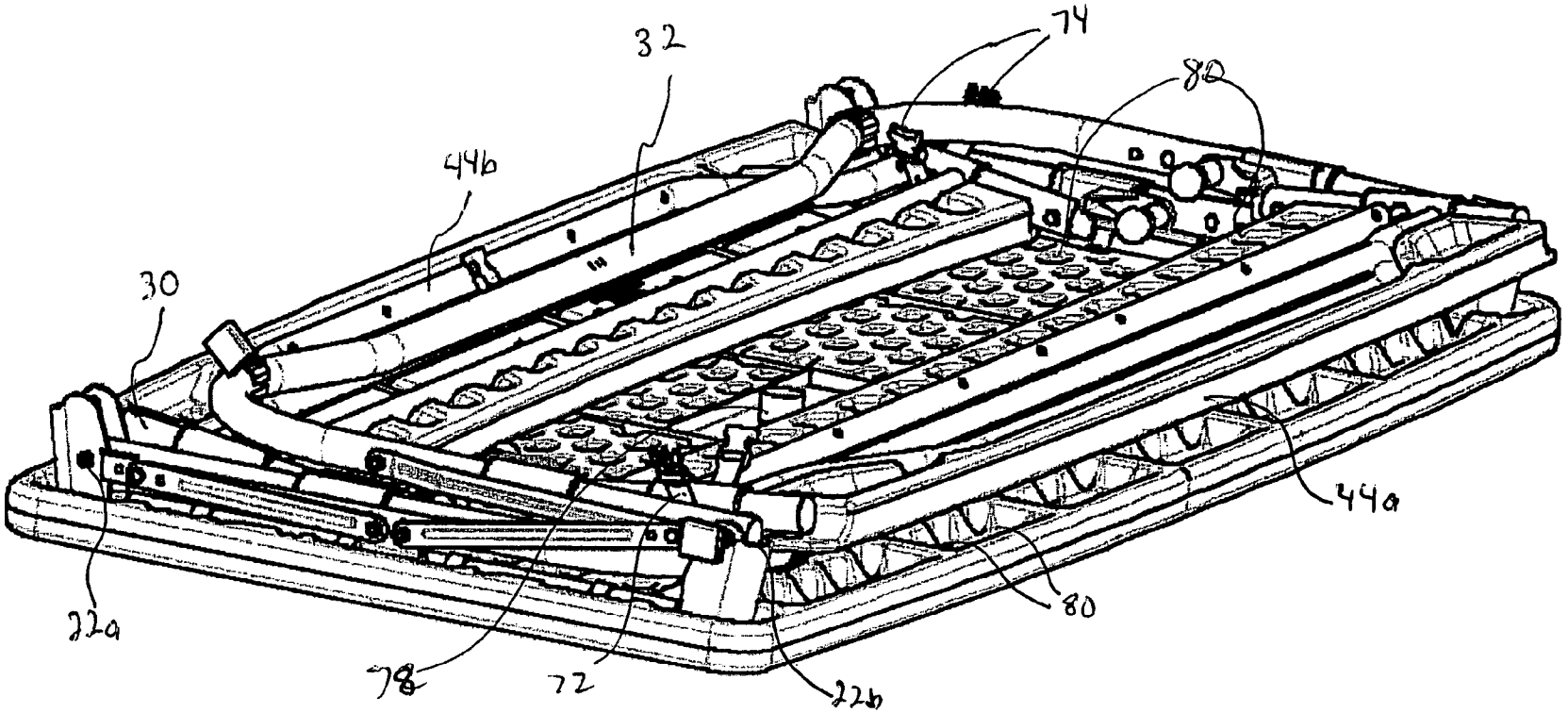
FIG. 12 is a perspective view of the embodiment of FIG. 9 illustrating the table in a folded arrangement.

FIGS. 9 and 10 also illustrate straps 72 associated with one or more bars 52. The straps are furnished with clips 74. When the legs of the table are folded, as illustrated in FIG. 12, the strap 72 associated with one leg 30, 32 may be used to engage another leg 32, 30 to aid in securing the legs 30, 32.

Pads 75 are provided on the portions of the legs 30, 32 that engage the surface, such as a floor or ground, in the embodiment illustrated in FIG. 9.

Also as shown in FIGS. 9 and 10, in one embodiment the second bar 36*b* on braces 34*a*, b attached to the first leg 30 is attached to the respective pivot bracket 24*a, b* at opening 42*a* and the second bar 36*b* on braces 34*c, d* attached to the second leg 32 are attached to the respective pivot bracket 24*a, b* at opening 42*b*. In other word, the second bar 36*b* is attached to the pivot bracket 24*a, b* through the opening on the same side of the table 10 on which the leg to which the braces 34*a, b, c, d* are attached is disposed. This is in contrast to the attachment to the pivot bracket 24*a, b* illustrated in FIG. 8. The second bars 36*b* do not corss each other in this embodiment.

FIG. 11 illustrates seat 44*b* pivoted upwardly. The table 10 may also be provided with a table hole 76 extending through the table top 11. Thus, the pole of an umbrella or the like (not shown) may be extended through the table hole 76. As illustrated in FIG. 12, this table hole 76 may be provided with a hole collar 78 to provide support for an umbrella or the like that may extend through the table hole 76.

FIG. 12 shows the table 10 with legs 30, 32 and seats 44*a, b* folded and collapsed in a storage position. In one embodiment, the bottom surface 14 of the table 10 is provided with a pattern of a plurality of indentations or recesses 80. The underneath surfaces of the seats 44*a, b* are also provided with a pattern of a plurality of indentations or recesses 80. Theses recesses 80 reduce the overall weight of the table 10.

Many of the individual features of the embodiments of the present invention may be combined into embodiments not illustrated without departing from the spirit and scope of the invention. For example, the pads 75 illustrated in the embodiment of FIG. 9 may also be provided on the embodiment illustrated in FIG. 1. And the straps 72 and clips 74 present in the embodiment illustrated in FIGS. 9 and 10 may also be provided with the embodiment illustrated in FIG. 4. Other combinations of features are also contemplated within the spirit and scope of the invention.

Figure 13:
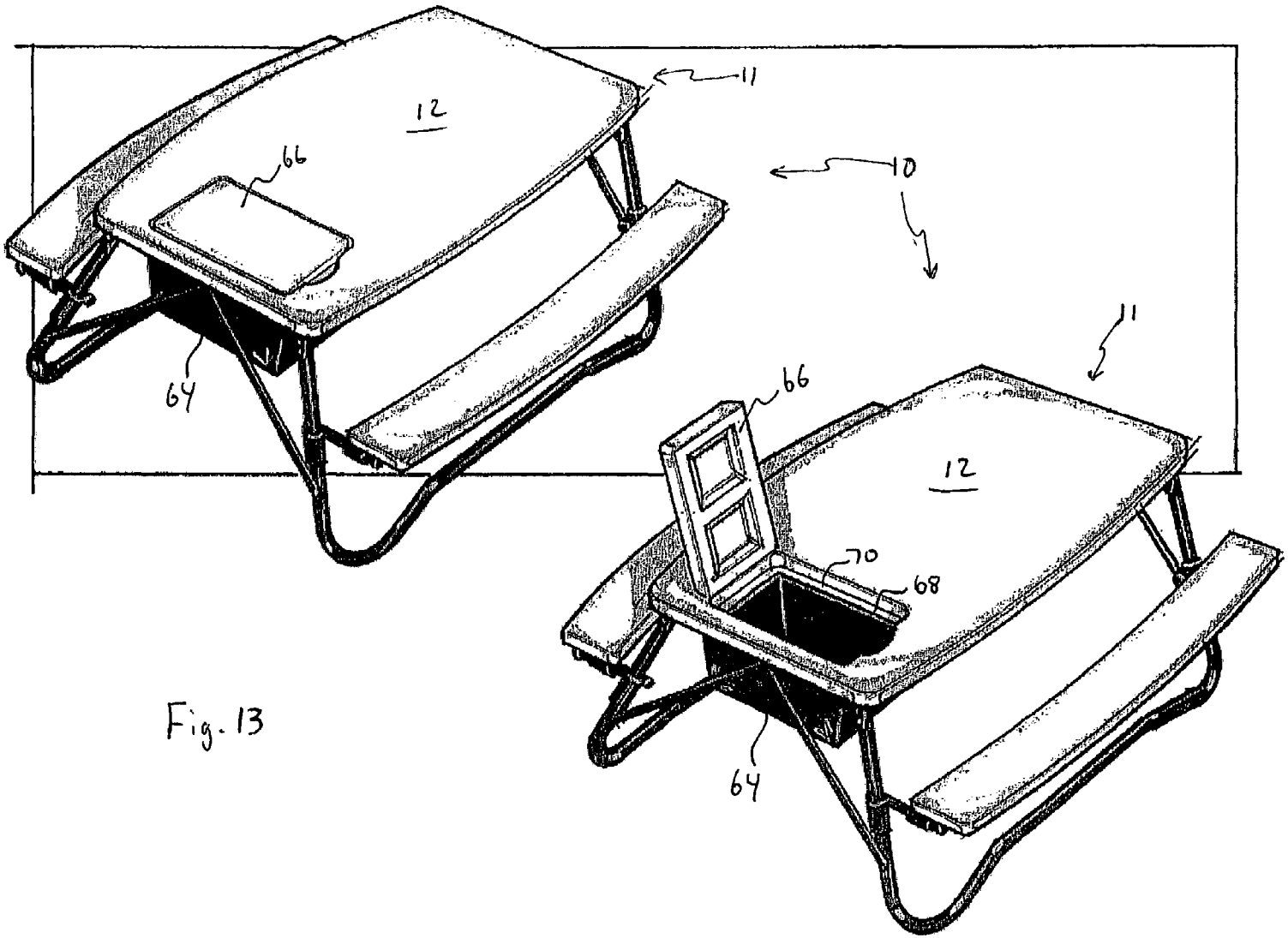
FIG. 13 is a perspective view of an embodiment of the present invention including a cooler.

FIG. 13 illustrates another embodiment of the present invention in which the table 10 is provided with a built-in cooler 64 and a lid 66. In this embodiment, a cavity or opening is provided in the table top 11 to enable a cooler 64 to be fastened to the table 10. Preferably, the cooler 64 is flexible and collapsible, and has soft sides to enable collapse. The soft-sided material of the cooler 64 is an insulating material that inhibits heat transfer between the material placed inside and the ambient atmosphere. Ice may be placed inside the cooler to cool items placed in the cooler, such as food and drinks. Or warm materials may be placed into the cooler to minimize ambient heat loss from the warm items to the ambient atmosphere. The cooler may be made of any collapsible insulating material without departing from the spirit or scope of the invention.

The lid 66 is hingedly attached to the table top 11 enabling the lid 66 to be opened to expose the interior of the cooler 64 and closed to cover the interior of the cooler 64. Alternatively, the lid 66 may be provided as a separate element not attached to the table top 11 and placed over the top of the cavity in the table top 11 to cover the interior of the cooler 64. In one embodiment, the lid 66 is held in place by a friction fit. In another embodiment, the lid 66 is held in place by clips, latches, locks, levers, or the like, or is held in place by any other device or method without departing from the spirit and scope of the invention. The lid 66 may also may constructed of insulating material.

When the lid 66 is closed or is placed over cooler 64, the lid 66 is substantially flush with the top surface 12, as shown in FIG. 13. In one embodiment, the opening in the table top 11 is provided with a lip 68. A part of the flexible cooler 64 is placed on this lip and a ring 70 is attached to the lip 68 with a part of the flexible cooler 64 secured therebetween. In this manner, the flexible cooler 64 may be locked in place by the engagement of the ring 70 with the lip 68.

The flexible cooler 64 may be collapsed into a storage position during the folding of the legs 30, 32 in order to provide a compact, folded table with an integral cooler 64. When the table 10 is unfolded and set up, gravity provides the motive force to expand the flexible cooler 64.

In another embodiment, the cavity or opening in the table top 11 is sized to accept therein a non-collapsible conventional cooler. The cavity may be provided with the lip 68 upon which at least part of the cooler, such as handles of the cooler, rests to prevent the cooler from completely passing through the opening. In another embodiment, at least part of the cooler, such as the handles of the cooler, rest on the top surface 12 to prevent the cooler from completely passing through the cavity.

While the present invention has been illustrated by the above description of embodiments, and while the embodiments have been described in some detail, it is not the intention of the applicants to restrict or in any way limit the scope of the invention to such detail. For example, the table need not be substantially rectangular and may be of any shape. Features of the illustrated embodiments may be combined, as discussed above, without departing from the spirit and scope of the invention. Additional advantages and modifications will readily appear to those skilled in the art. Therefore, the invention in its broader aspects is not limited to the specific details, representative apparatus and methods, and illustrative examples shown and described. Accordingly, departures may be made from such details without departing from the spirit or scope of the applicants' general or inventive concept.

We claim:

1. A table with folding legs, comprising:

a. a table top comprising a top surface, a bottom surface, and a peripheral edge;

b. a first bracket and a second bracket affixed to the bottom surface and comprising a first pair of holes disposed at a first distance from the bottom surface;

c. a third bracket and a fourth bracket affixed to the bottom surface and comprising a second pair of holes disposed at a second distance from the bottom surface;

d. a first leg pivotally attached to at least one of the first pair of holes and a second leg pivotally attached to at least one of the second pair of holes;

e. a first pivot bracket disposed between the first bracket and the fourth bracket and a second pivot bracket disposed between the second bracket and the third bracket, the first pivot bracket and the second pivot bracket being non-slidably affixed to the bottom surface.

2. The table of claim 1, wherein the first leg and the second leg are substantially U-shaped.

3. The table of claim 1, wherein the first distance is different from the second distance.

4. A table with folding legs, comprising:

a) a table top comprising a top surface, a bottom surface, and a peripheral edge;

b) a first bracket and a second bracket affixed to the bottom surface and comprising a first pair of holes disposed at a first distance from the bottom surface;

c) a third bracket and a fourth bracket affixed to the bottom surface and comprising a second pair of holes disposed at a second distance from the bottom surface;

d) a first leg pivotally attached to at least one of the first pair of holes and a second leg pivotally attached to at least one of the second pair of holes;

e) a first pivot bracket disposed between the first bracket and the fourth bracket and a second pivot bracket disposed between the second bracket and the third bracket;

f) a first support brace extending between and connected to the first pivot bracket and the first leg, a second support brace extending between and connected to the second pivot bracket and the first leg, a third support brace extending between and connected to the second pivot bracket and the second leg, and a fourth support brace extending between and connected to the first pivot bracket and the second leg.

5. The table of claim 4, where each support brace comprises a first bar and a second bar pivotally attached to the first bar.

6. The table of claim 5, further comprising means for locking the first bar and the second bar, substantially preventing the first bar and the second bar from pivoting relative to each other.

7. The table of claim 5, further comprising a lockable connection between the first bar and the second bar.

8. The table of claim 1, further comprising a first seat attached to the first leg and a second seat attached to the second leg.

9. The table of claim 8, wherein the first seat is pivotally attached to the first leg and the second seat is pivotally attached to the second leg.

10. The table of claim 8, wherein at least one of the first seat and the second seat is adjustable vertically, horizontally, or both.

11. The table of claim 8, wherein the legs with the attached seats are capable of being folded such that the legs and seats are substantially adjacent the bottom surface of the table top and do not extend outwardly of the peripheral edge.

12. A table with folding legs, comprising:

a. a generally rectangular table top comprising first, second, third, and fourth corners, a top surface and a bottom surface, a first side and a second side, and a first end and a second end;

b. a first corner bracket, a second corner bracket, a third corner bracket, and a fourth corner bracket affixed to the bottom surface at, respectively, the first corner, the second corner, the third corner, and the fourth corner, each corner bracket comprising a first pair of holes disposed at a first distance from the bottom surface or a second pair of holes disposed at a second distance from the bottom surface;

c. a first generally U-shaped leg pivotally attached to the first corner bracket and the second corner bracket at the first pair of holes;

d. a second generally U-shaped leg pivotally attached to the third corner bracket and the fourth corner bracket at the second pair of holes;

e. a first pivot bracket attached to the bottom surface at the first end between the first side and the second side;

f. a second pivot bracket attached to the bottom surface at the second end between the first side and the second side;

g. a first support brace pivotally attached to the first leg and pivotally attached to the first pivot bracket, the first support brace comprising first and second bars pivotally connected to each other and lockable to selectively prevent pivot of the first and second bars relative to each other; and h. a second support brace pivotally attached to the second leg and pivotally attached to the first pivot bracket, the second support brace comprising first and second bars pivotally connected to each other and lockable to selectively prevent pivot of the first and second bars relative to each other.

13. The table of claim 12, further comprising at least one seat attached to one of the first leg and the second leg, the seat being positionally adjustable vertically and horizontally.

14. The table of claim 13, wherein the at least one seat comprises one seat attached to the first leg and one seat attached to the second leg.

15. The table of claim 1, further including a cavity in the table top for receiving a cooler therein.

16. The table of claim 15, further comprising a collapsible cooler having an interior mounted in the cavity in the table top, wherein the collapsible cooler comprises insulating material that inhibits heat transfer between the interior of the cooler and the ambient atmosphere.

17. The table of claim 16, further comprising a lid hingedly attached at the table top and capable of covering the interior of the cooler, the lid having an open position and a closed position, wherein the lid is substantially flush with the top surface when in the closed position.

18. The table of claim 15, further comprising at least one seat attached to at least one of the foldable legs.

* * * * *